US010641039B2

(12) United States Patent
Chen

(10) Patent No.: US 10,641,039 B2
(45) Date of Patent: May 5, 2020

(54) CORD SEPARATOR FOR BLIND CORD WINDING MECHANISM

(71) Applicant: SHEEN WORLD TECHNOLOGY CORPORATION, Taichung (TW)

(72) Inventor: Po-Yu Chen, Taichung (TW)

(73) Assignee: SHEEN WORLD TECHNOLOGY CORPORATION, Taichung (TW)

( * ) Notice: Subject to any disclaimer, the term of this patent is extended or adjusted under 35 U.S.C. 154(b) by 18 days.

(21) Appl. No.: 15/888,686

(22) Filed: Feb. 5, 2018

(65) Prior Publication Data

US 2019/0063150 A1 Feb. 28, 2019

(30) Foreign Application Priority Data

Aug. 28, 2017 (TW) ..... 106129212 A

(51) Int. Cl.
*E06B 9/322* (2006.01)
*E06B 9/382* (2006.01)
*E06B 9/68* (2006.01)

(52) U.S. Cl.
CPC ..... *E06B 9/382* (2013.01); *E06B 9/322* (2013.01); *E06B 9/68* (2013.01)

(58) Field of Classification Search
CPC . E06B 9/382; E06B 9/322; E06B 9/68; E06B 2009/3225; E06B 2009/3227; B65H 75/4402; B65H 75/4405; B65H 57/00; B65H 57/02; B65H 57/16; B65H 57/26; B65H 57/14
USPC ..... 160/170
See application file for complete search history.

(56) References Cited

U.S. PATENT DOCUMENTS 842,401 A * 1/1907 Goodell ..... E06B 9/322 160/170
1,949,653 A * 3/1934 Moore ..... E06B 9/304 160/168.1 R
2,164,556 A * 7/1939 Udstad ..... E06B 9/303 160/170
2,298,538 A * 10/1942 McKerlie ..... E06B 9/304 160/170
2,562,259 A * 7/1951 Burns ..... E06B 9/308 160/170
3,004,733 A * 10/1961 Spivey ..... B65H 57/00 242/157 R
5,531,257 A * 7/1996 Kuhar ..... E06B 9/32 160/168.1 P
5,799,715 A * 9/1998 Biro ..... E06B 9/322 160/170

(Continued)

*Primary Examiner* — Daniel P Cahn

(57) ABSTRACT

A cord separator used in a blind cord winding mechanism is disclosed to include a support portion, two wing portions respectively and outwardly extended from two opposite lateral sides of the support portion and respectively defining therein a cord insertion hole for the passing of one respective transmission cord, and two extension portions respectively perpendicularly extended from the wing portions along the axial direction of the cord insertion holes in parallel manner and respectively terminating in a positioning end portion for hooking on one respective side post of the blind cord winding mechanism so that the cord separator is capable of separating two transmission cords of the blind cord winding mechanism and preventing the two transmission cords from interfering with each other or being tangled during transmission.

4 Claims, 3 Drawing Sheets

(56) References Cited

U.S. PATENT DOCUMENTS 6,761,203 B1 * 7/2004 Huang ..... E06B 9/322 160/170
7,331,370 B1 * 2/2008 Militello ..... E06B 9/322 160/170
8,087,445 B2 * 1/2012 DeWard ..... E06B 9/322 160/170
8,936,062 B2 * 1/2015 Huang ..... E06B 9/322 160/170
9,874,057 B2 * 1/2018 Huang ..... E06B 9/322
9,957,750 B2 * 5/2018 Lin ..... E06B 9/262
10,273,748 B2 * 4/2019 Chen ..... B65H 57/14
2004/0108079 A1 * 6/2004 Gilmore ..... E06B 9/322 160/170
2007/0227677 A1 * 10/2007 Yu ..... E06B 9/322 160/170
2007/0261798 A1 * 11/2007 Hung ..... E06B 9/322 160/170
2008/0099157 A1 * 5/2008 Nien ..... E06B 9/322 160/84.05
2010/0084099 A1 * 4/2010 Chou ..... E06B 9/307 160/170
2013/0255890 A1 * 10/2013 Mullet ..... E06B 9/307 160/168.1 P
2013/0313497 A1 * 11/2013 Hsu ..... E06B 9/262 254/394
2014/0083631 A1 * 3/2014 Huang ..... E06B 9/322 160/170
2014/0262063 A1 * 9/2014 Huang ..... E06B 9/322 160/84.02
2014/0262079 A1 * 9/2014 Filko ..... E06B 9/322 160/311
2015/0136892 A1 * 5/2015 Hung ..... E06B 9/322 242/397.5
2015/0275572 A1 * 10/2015 Huang ..... E06B 9/322 160/173 R
2016/0053533 A1 * 2/2016 Chen ..... E06B 9/322 160/173 R
2016/0138330 A1 * 5/2016 Huang ..... E06B 9/262 160/170
2016/0312528 A1 * 10/2016 Huang ..... E06B 9/322
2016/0340975 A1 * 11/2016 Huang ..... E06B 9/322

* cited by examiner

CORD SEPARATOR FOR BLIND CORD WINDING MECHANISM

BACKGROUND OF THE INVENTION

1. Field of the Invention

The present invention relates to window blind technology, and more particularly to a cord separator for use in a blind cord winding mechanism of a window blind.

2. Description of the Related Art

In regular window blinds, the extending out or receiving the slats is performed through the transmission of pairs of transmission cords. For example, when receiving the slats, the transmission cords are rolled up to lift the bottom rail as the winding gears are driven to rotate, and thus the slats are lifted by the bottom rail and received in a stack.

In prior art designs, the transmission cords can interfere with each other or can be tangled, resulting unsmoothness of the lifting of the slats or even causing the slats to get stuck.

SUMMARY OF THE INVENTION

The present invention has been accomplished under the circumstances in view. It is the main object of the present to provide a cord separator for blind cord winding mechanism, which prevents the transmission cords from interfering with each other or being tangled during transmission.

To achieve this and other objects of the present invention, a cord separator is used in a blind cord winding mechanism, comprising a support portion, two wing portions and two extension portions. The two wing portions are respectively and outwardly extended from two opposite lateral sides of the support portion, each wing portion defining therein a cord insertion hole. The extension portions are respectively perpendicularly extended from the wing portions along the axial direction of the cord insertion holes in parallel manner, and respectively terminating in a positioning end portion.

Preferably, the support portion is an elongated member; the two wing portions are respectively extended from the support portion at different elevations and disposed in rotational symmetry along with a long axis of said elongated member; the two cord insertion holes are disposed at different elevations.

Other advantages and features of the present invention will be fully understood by reference to the following specification in conjunction with the accompanying drawings, in which like reference signs denote like components of structure.

DETAILED DESCRIPTION OF THE INVENTION

Figure 1:
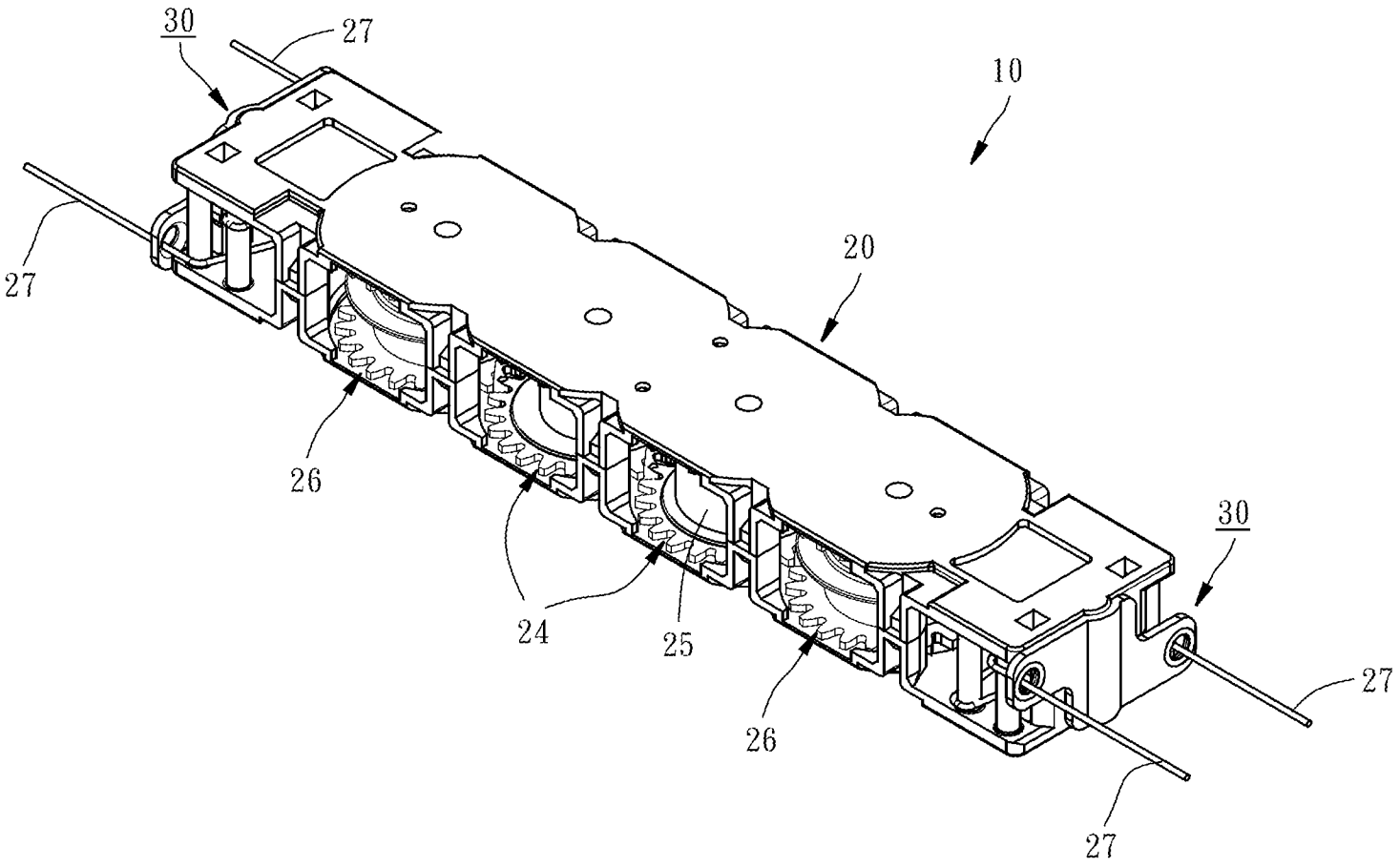
FIG. 1 illustrates two cord separator mounted at two opposite ends of a blind cord winding mechanism in accordance with the present invention.
Figure 2:
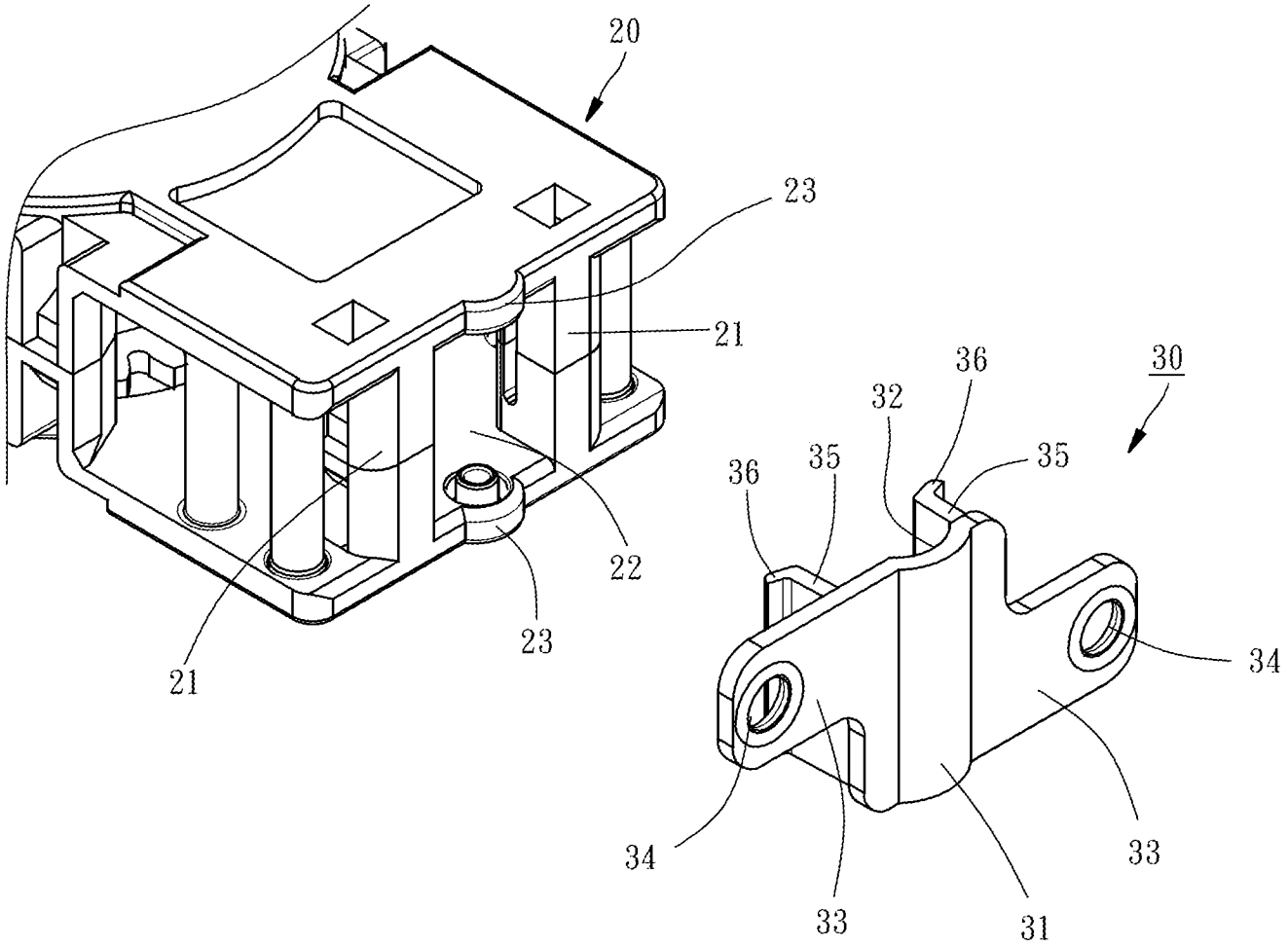
FIG. 2 is an exploded view of a part of FIG. 1, illustrating the structure of the cord separator.

Referring to FIG. 1 and FIG. 2, a regular blind cord winding mechanism 10 is used in a window blind for controlling receiving and extending out of the slats, which structurally comprises a casing 20, two driving gears 24, a coil spring 25, two transmission cord winding gears 26, and four transmission cords 27 that are arranged in pairs. The casing 20 comprises two opposite side posts 21 bilaterally disposed in parallel at each of two opposite ends thereof, an end opening 22 defined between each pair of side posts 21, and two protruding portions 23 located at opposite top and bottom sides of each end opening 22. The two driving gears 24 are rotatably mounted in the casing 20 and meshed with each other. The coil spring 25 is connected between the two driving gears 24, and can be extended out from the coiled status upon rotation of the driving gears 24. The two transmission cord winding gears 26 are rotatably mounted in the casing 20 and respectively meshed with one respective driving gear 24 so that the two transmission cord winding gears 26 can be driven to rotate by the respective driving gears 24. The two pairs of transmission cords 27 are respectively mounted around one respective transmission cord winding gear 26 at different elevations so that each pair of transmission cords 27 can be rolled up by the respective transmission cord winding gear 26 or let off from the respective transmission cord winding gear 26.

Referring to FIG. 2, a cord separator 30 comprises a support portion 31, two wing portions 33, and two extension portions 35. The support portion 31 is an elongated member having an arched cross section. The two wing portions 33 are respectively and outwardly extended from two opposite lateral sides of the support portion 31, each wing portion defining therein a cord insertion hole 34. Further, the two wing portions 33 are respectively extended from the support portion 31 at different elevations and disposed in rotational symmetry along with a long axis of the support portion 31 so that the cord insertion holes 34 of the wing portions 33 are disposed at different elevations for the passing of one respective pair of transmission cords 27. The two extension portions 35 are respectively perpendicularly extended from the wing portions 33 along the axial direction of the cord insertion holes 34 in parallel manner, and respectively terminating in a positioning end portion 36.

Figure 3:
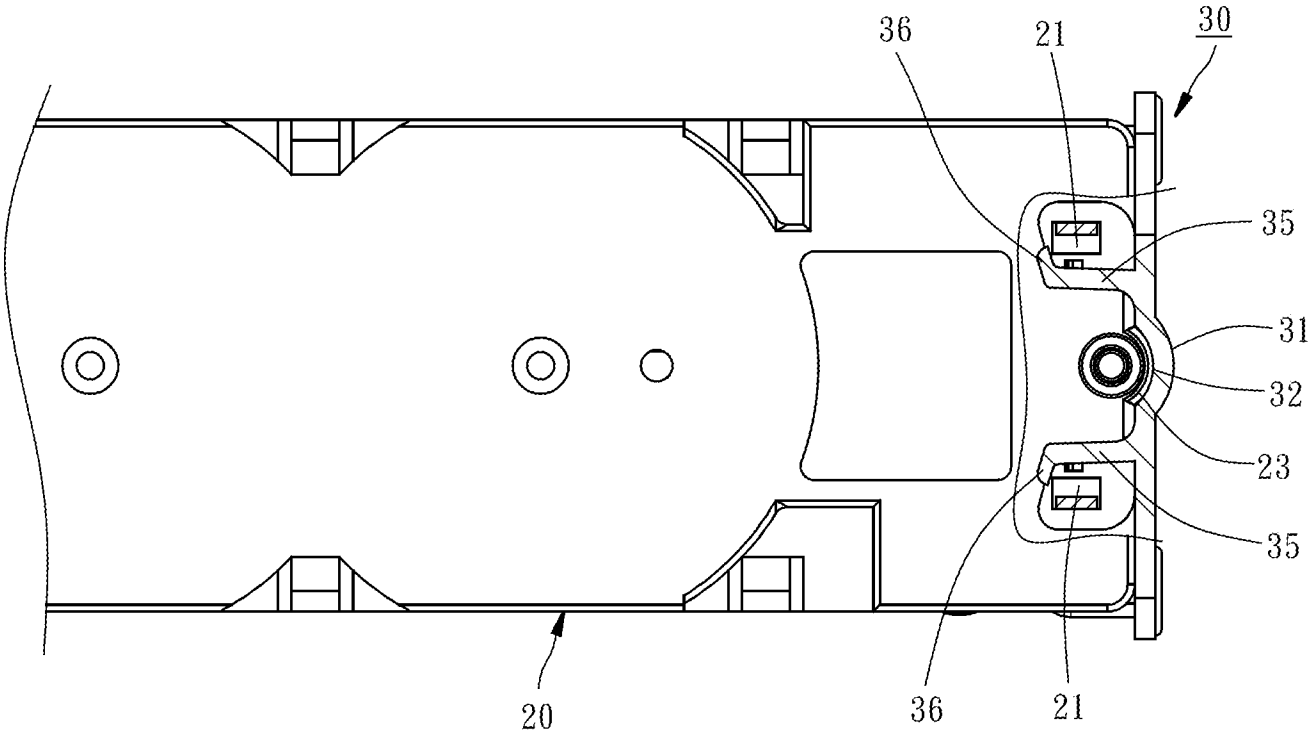
FIG. 3 is a sectional view of a part of FIG. 1, illustrating the positioning of the cord separator in the blind cord winding mechanism.

In application, two cord separators 30 are respectively mounted at the two opposite ends of the casing 20 of the blind cord winding mechanism 10 to face toward the respective transmission cord winding gears 26. In installation, as illustrated in FIG. 3, insert the two extension portions 35 into the end opening 22 at one end of the casing 20 to force an inner concave surface 32 of the support portion 31 into abutment against the two protruding portions 23 at the respective end of the casing 20, enabling the positioning end portions 36 of the two extension portions 35 to be respectively hooked on the respective side posts 21 of the casing 20 to complete the installation. After installation, as illustrated in FIG. 1, the cord separator 30 separates the two transmission cords 27, preventing the two transmission cords 27 from interfering with each other or being tangled during transmission and enhancing the transmission smoothness and stability.

What is claimed is:

1. A blind cord winding mechanism, comprising:

a casing having a rectangular shape which is provided with a pair of opposite ends, two side posts disposed in parallel at one of the pair of opposite ends, and an end opening defined between said two side posts;

two driving gears being rotatably mounted in said casing and meshed with each other;

a coil spring being connected between said two driving gears and can be extended out upon rotation of said two driving gears;

a cord separator comprising a support portion, two wing portions and two extension portions, said two wing portions being respectively and outwardly extended from two opposite lateral sides of said support portion, each of said two wing portions defining therein a cord insertion hole and having an outer surface facing one of said two driving gears, said two extension portions being respectively perpendicularly extended from said outer surface of said two wing portions and each of said two extension portions being respectively terminating in a positioning end portion, said two extension portions being inserted into said end opening in a direction toward one of said two driving gears and said positioning end portions of said two extension portions being hooked on said two side posts respectively.

2. The blind cord winding mechanism as claimed in claim 1, wherein said support portion is an elongated member; said two wing portions are respectively extended from said support portion at different elevations and disposed in rotational symmetry along with a long axis of said support portion.

3. The blind cord winding mechanism as claimed in claim 1, wherein said support portion has an arched cross section.

4. The blind cord winding mechanism as claimed in claim 1, wherein said cord insertion hole of each said wing portion is disposed at different elevations.

* * * * *